US005655247A

United States Patent [19]

Allen et al.

[11] Patent Number: 5,655,247

[45] Date of Patent: Aug. 12, 1997

[54] WINDOW CLEANING APPARATUS

[75] Inventors: Charles Allen, Newcastle Upon Tyne; Richard Pawson, Reading; Mohammed Farsi, Newcastle Upon Tyne; Peter Johnson, Woldingham, all of United Kingdom

[73] Assignee: O.C.S. Group Limited, Surrey, United Kingdom

[21] Appl. No.: 341,588

[22] PCT Filed: May 26, 1993

[86] PCT No.: PCT/GB93/01084

§ 371 Date: Mar. 16, 1995

§ 102(e) Date: Mar. 16, 1995

[87] PCT Pub. No.: WO93/24044

PCT Pub. Date: Dec. 9, 1993

[30] Foreign Application Priority Data

May 26, 1992 [GB] United Kingdom ..... 9211146

[51] Int. Cl.[6] ..... A47L 1/02

[52] U.S. Cl. ..... 15/103; 15/50.1; 15/302

[58] Field of Search ..... 15/103, 250.11, 15/302, 50.1, 50.2, 50.3, 52, 319; 134/172

[56] References Cited

U.S. PATENT DOCUMENTS

| | | | |
|---|---|---|---|
| 2,517,474 | 9/1950 | Fouse | 15/103 |
| 3,218,663 | 11/1965 | Battista | 15/250.11 |
| 4,198,724 | 4/1980 | Fisher et al. | 15/103 |
| 4,809,384 | 3/1989 | Yokota et al. | 15/103 |
| 5,020,180 | 6/1991 | Mimura | 15/250.11 |
| 5,032,775 | 7/1991 | Mizuno et al. | 15/319 |

FOREIGN PATENT DOCUMENTS

| | | | |
|---|---|---|---|
| 2145619 | 4/1985 | United Kingdom | 15/103 |

*Primary Examiner*—Tony G. Soohoo
*Attorney, Agent, or Firm*—Nixon & Vanderhye

[57] ABSTRACT

A cleaning device for cleaning windows comprises an elongate wiper element (C) which is robotically controlled to move across the surface of the window to apply and remove cleaning fluid therefrom. The robotic control can be arranged so that the movement of the wiper element corresponds to that which it would follow if used manually by a skilled window cleaner. The wiper element maintains continuous contact with the entire surface of the window without displacement of the wiper from the surface of the window during cleaning.

21 Claims, 10 Drawing Sheets

WINDOW CLEANING APPARATUS

DESCRIPTION

This invention relates to the cleaning of windows and has for its objective the provision of an automatic means capable of cleaning windows of any size and inclination.

The cleaning of a window involves washing, usually with water and detergent, followed by wiping to remove liquid. Manually, this is typically achieved with a sponge wet with cleaning liquid followed by a flexible blade or squeegee. An automatic cleaning arrangement has been proposed wherein an elongate wiping blade of the dimensions of the window moves in a rectilinear path across the window. Such an arrangement has constructional and operational disadvantages.

In accordance with the present invention the cleaning device comprises an elongate wiper which has a length less than any side of the window and is robotically controlled to move across the entire surface area of the window to remove cleaning liquid therefrom. To achieve this, one side only of the elongate member, hereinafter called the blade, contacts the cleaning liquid being removed, a continuous sweep being made to define a moving body of liquid.

The robotic control means will be preferably such as to cause the blade to simulate the movements made by the human arm and the hand rather than to describe strictly rectilinear movements parallel to the sides of the window.

Preferably the robotic control means will initially act, using the blade as a sensing means, to sense the dimensions of the window to be cleaned. A computer will then establish the pattern of movements of the blade over the window. The wiping blade should have longitudinal compliance so that its ends can contact the window margin and be moved to actuate sensing means. Compliance normal to the blade length is also desirable to enable the blade to contact the window with the desired force. This compliance will preferably have two modes; a first datum mode to sense by contact as set out above, and a second stiffer cleaning mode.

Although a cleaning head including the blade may comprise a liquid applicator, for example a jet or spray, separate from the wiping blade, it is presently preferred to incorporate washing means such as a brush and the wiping blade in an elongate cleaning head. Preferably this head will include a vacuum space between the brush and blade for removing cleaning liquid during and particularly at the finish of cleaning.

The robotic control means will be of any suitable form but we have found it possible to provide an effective cleaning pattern using a robot with Cartesian mountings, i.e. a robot which allows movement of the head in the three axes at right angles; a horizontal lateral X axis, a Z axis normal to the X axis allowing horizontal movement towards and away from the window, and a vertical Y axis. The cleaning head is rotatable about the Z axis to provide the full range of movements required with operational simplicity and robustness. The head may also be mounted for limited tilting movement to allow for inclination of the window pane.

The invention will now be described by way of example and with reference to the accompanying drawings wherein.

Figure 3A:
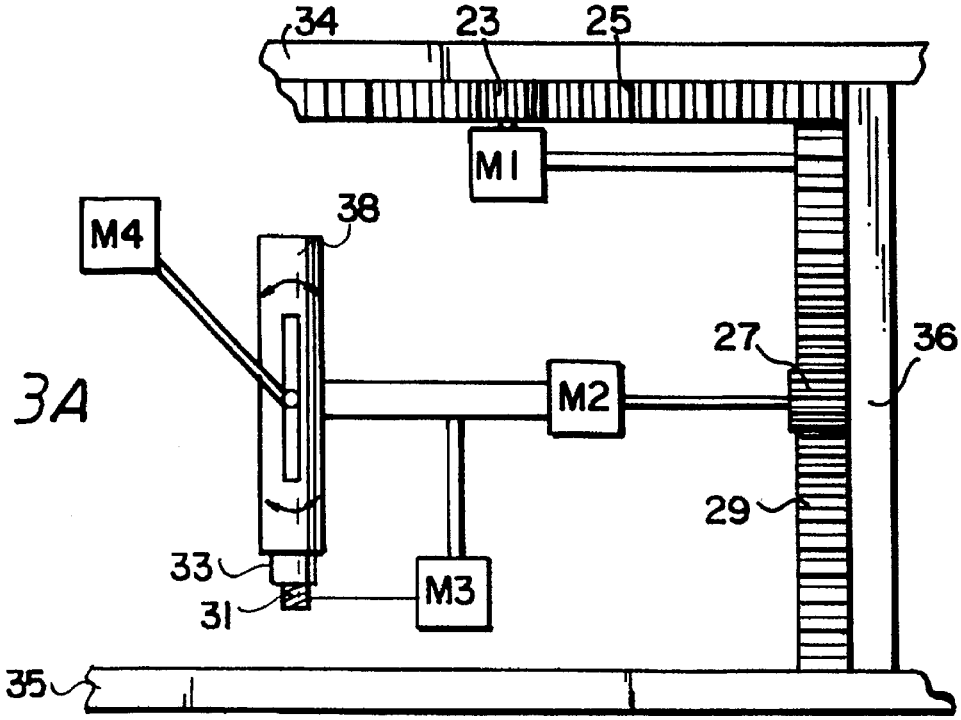
FIG. 3 is a view of a cleaning apparatus incorporating the present invention mounted on the exterior of a building.
Figure 4:
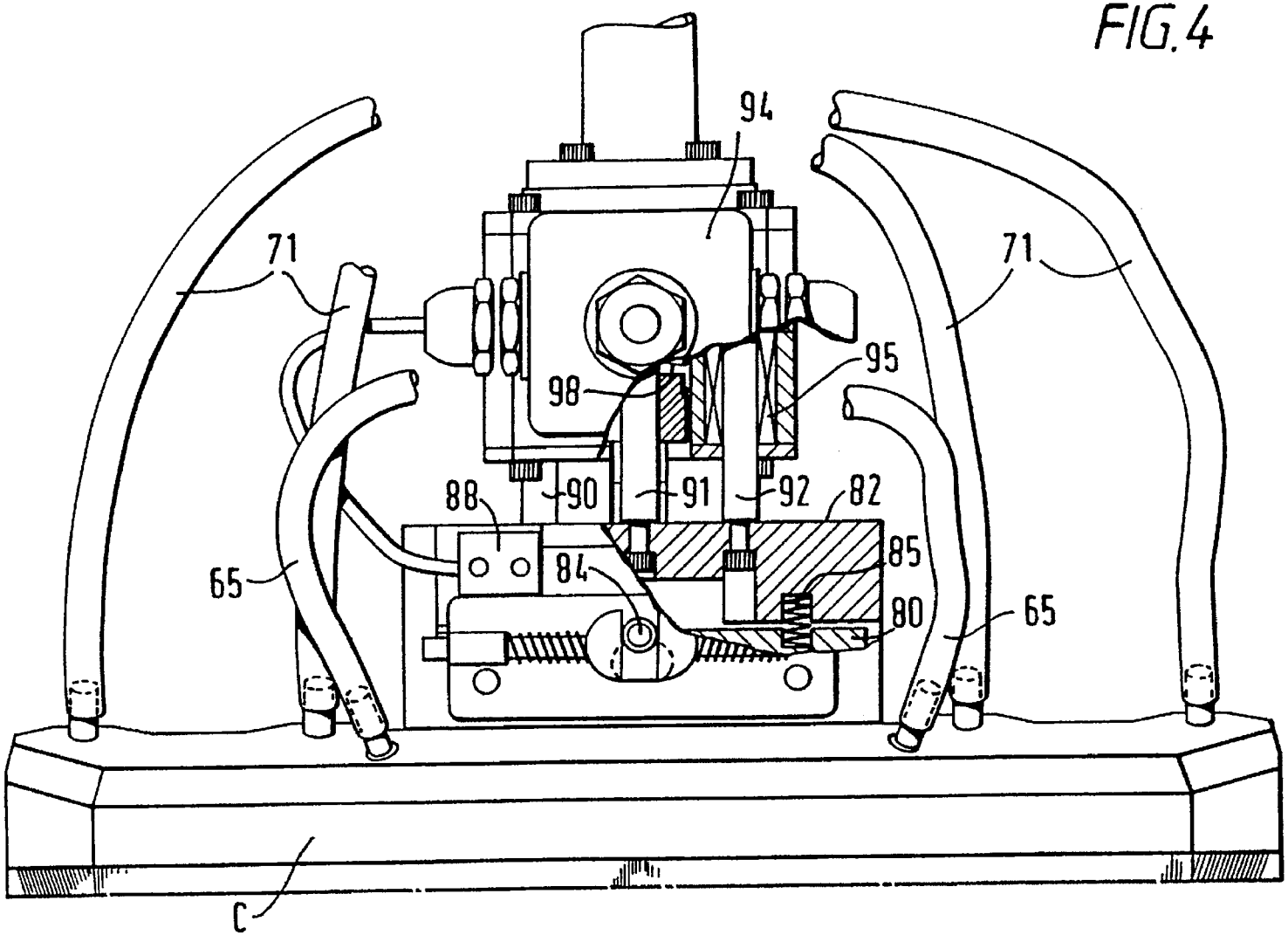
Figure 5:
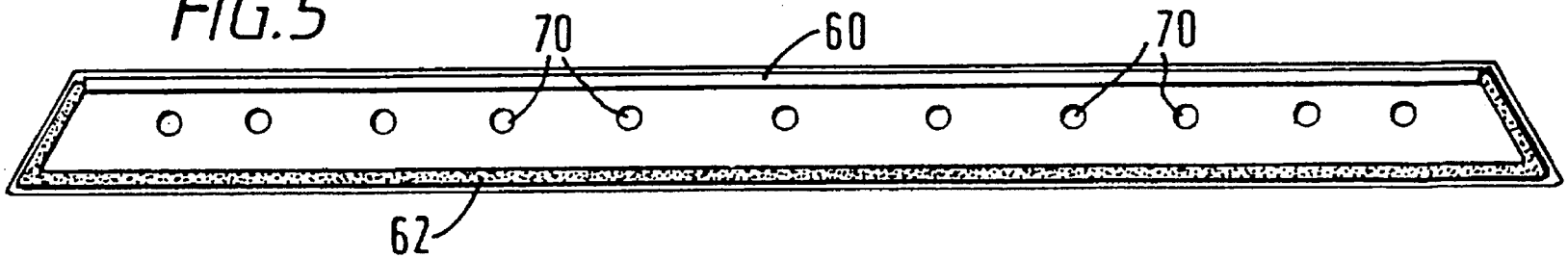
Figure 6:
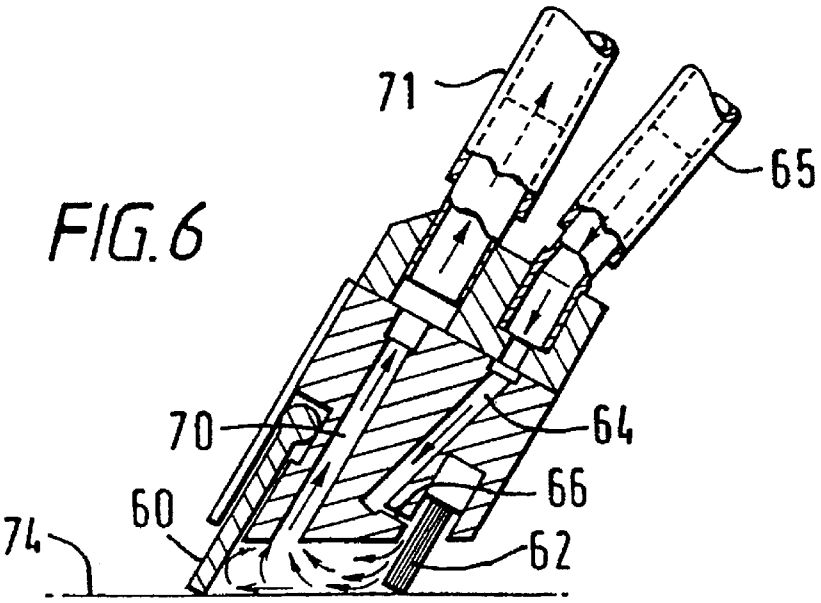
Figure 7:
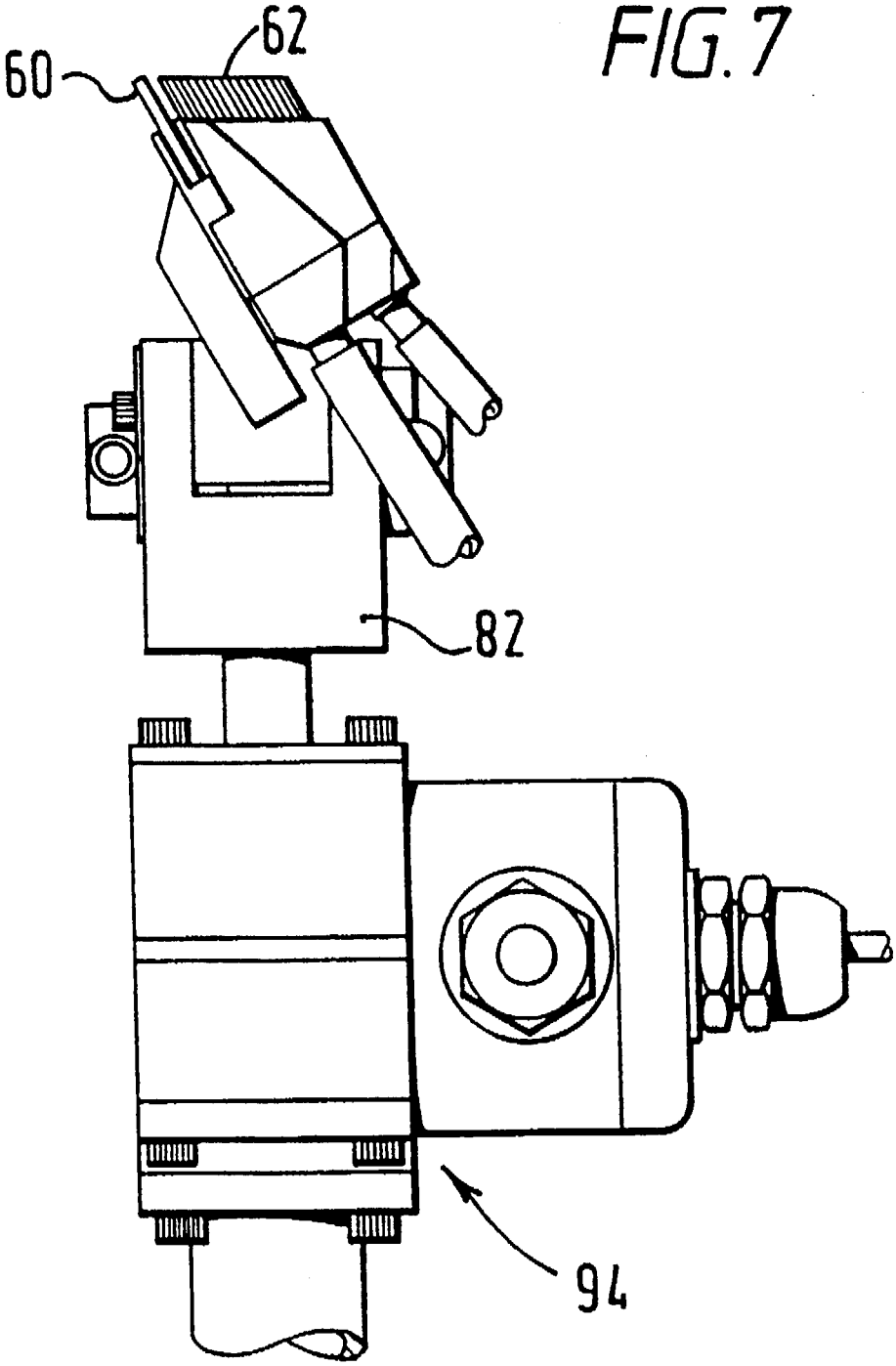
Figure 8:
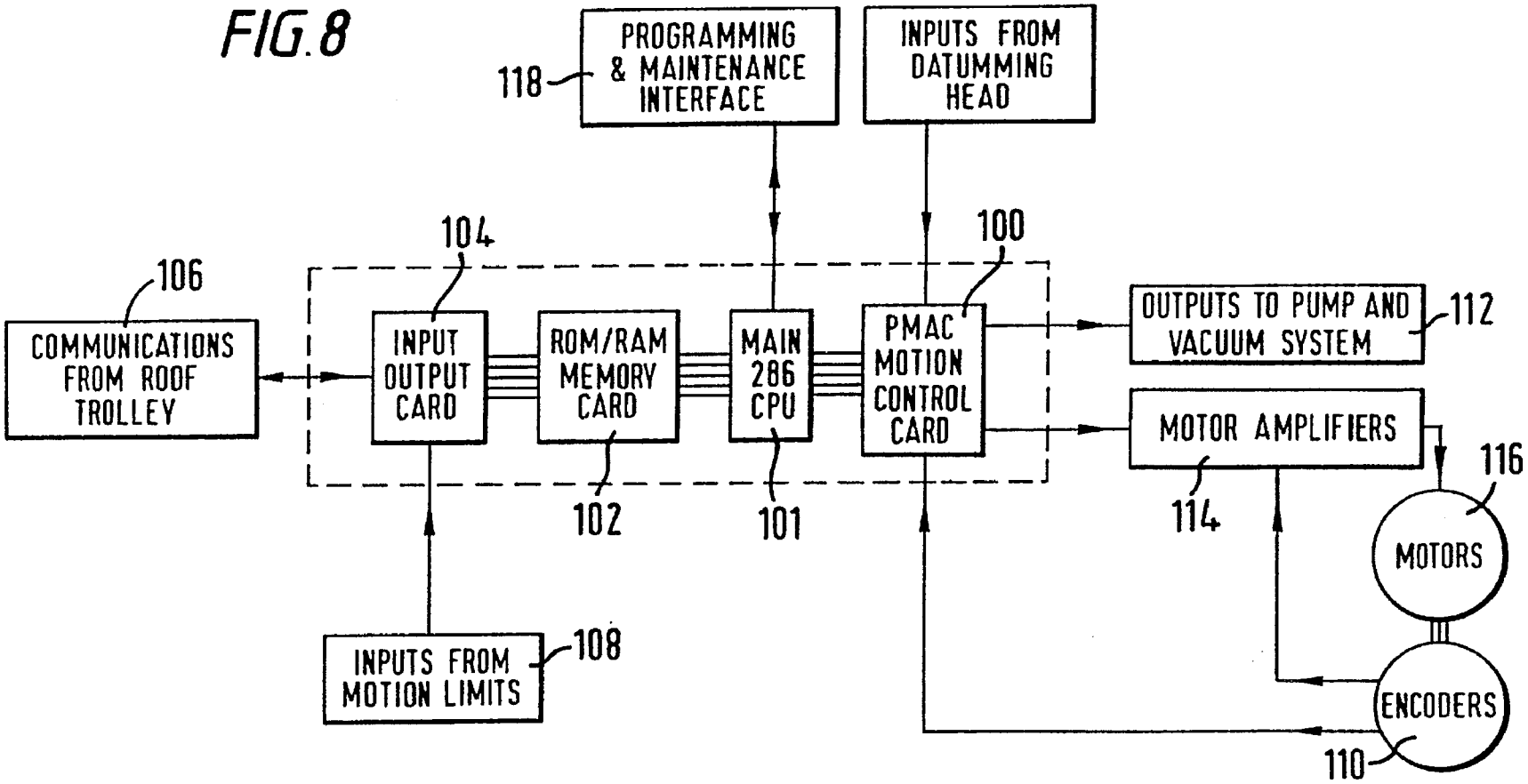

FIG. 3*a* is a schematic illustration of motor-driven racks and pinions for displacing the wiper element along X, Y and Z axes;

FIG. 4 is a plan view partly in section of one form of cleaning head mounting;

FIG. 5 is a front view of the cleaning head;

FIG. 6 is a sectional view of the cleaning head;

FIG. 7 is a side view of the cleaning head mounting;

FIG. 8 is a block scehmatic diagram of the robot control circuitry, and

Figure 9:
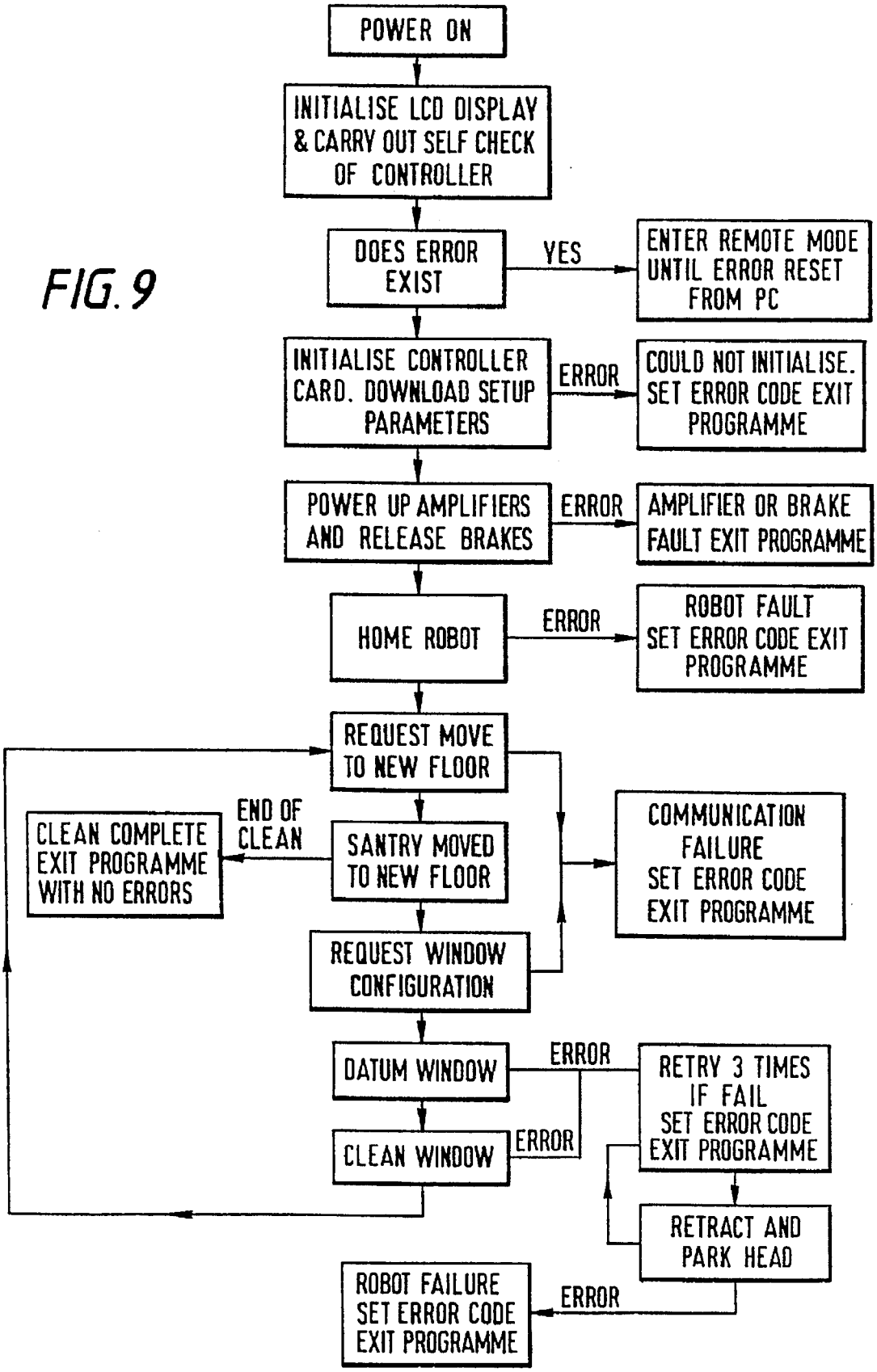
Figure 10:
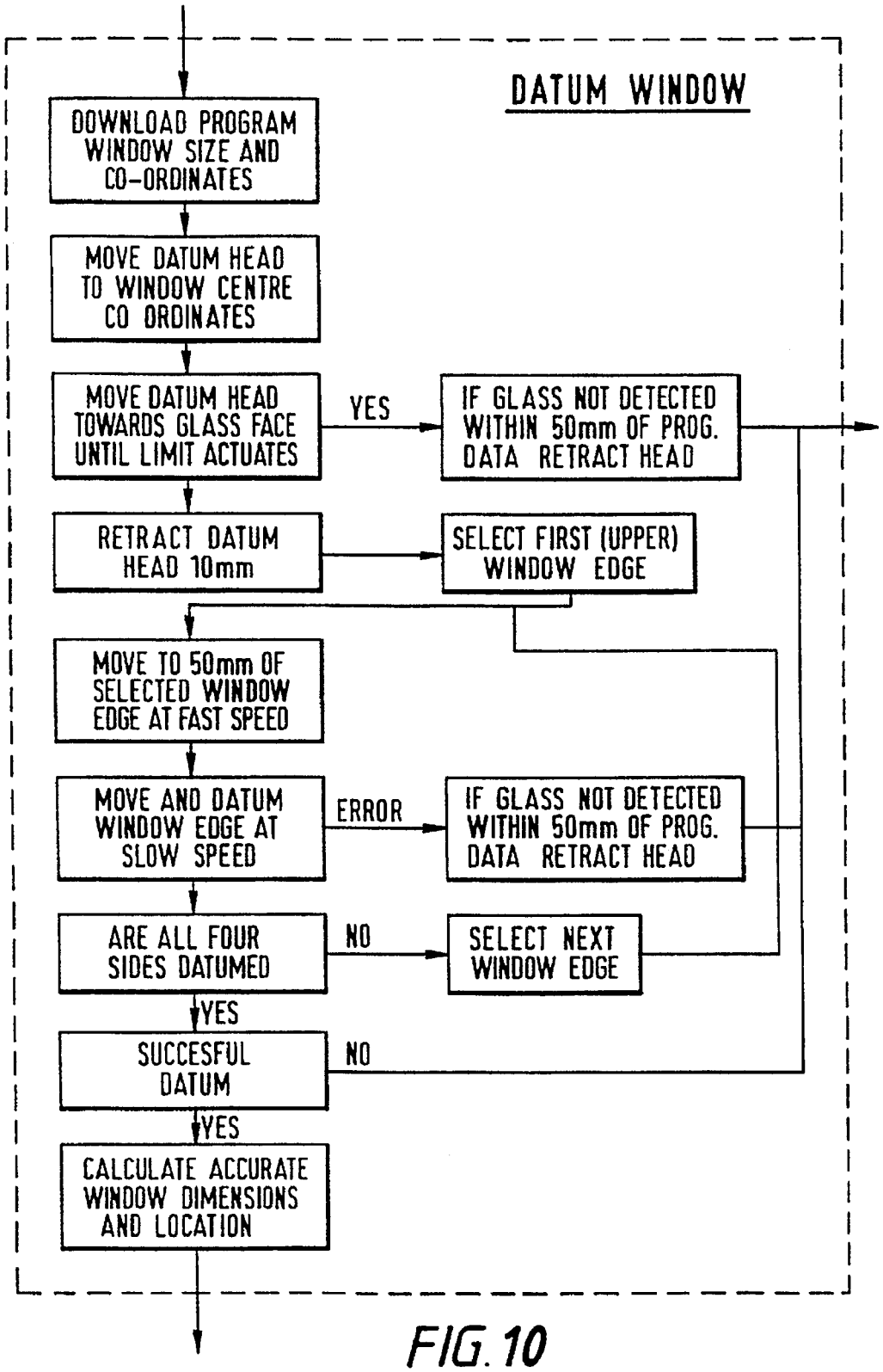
Figure 11:
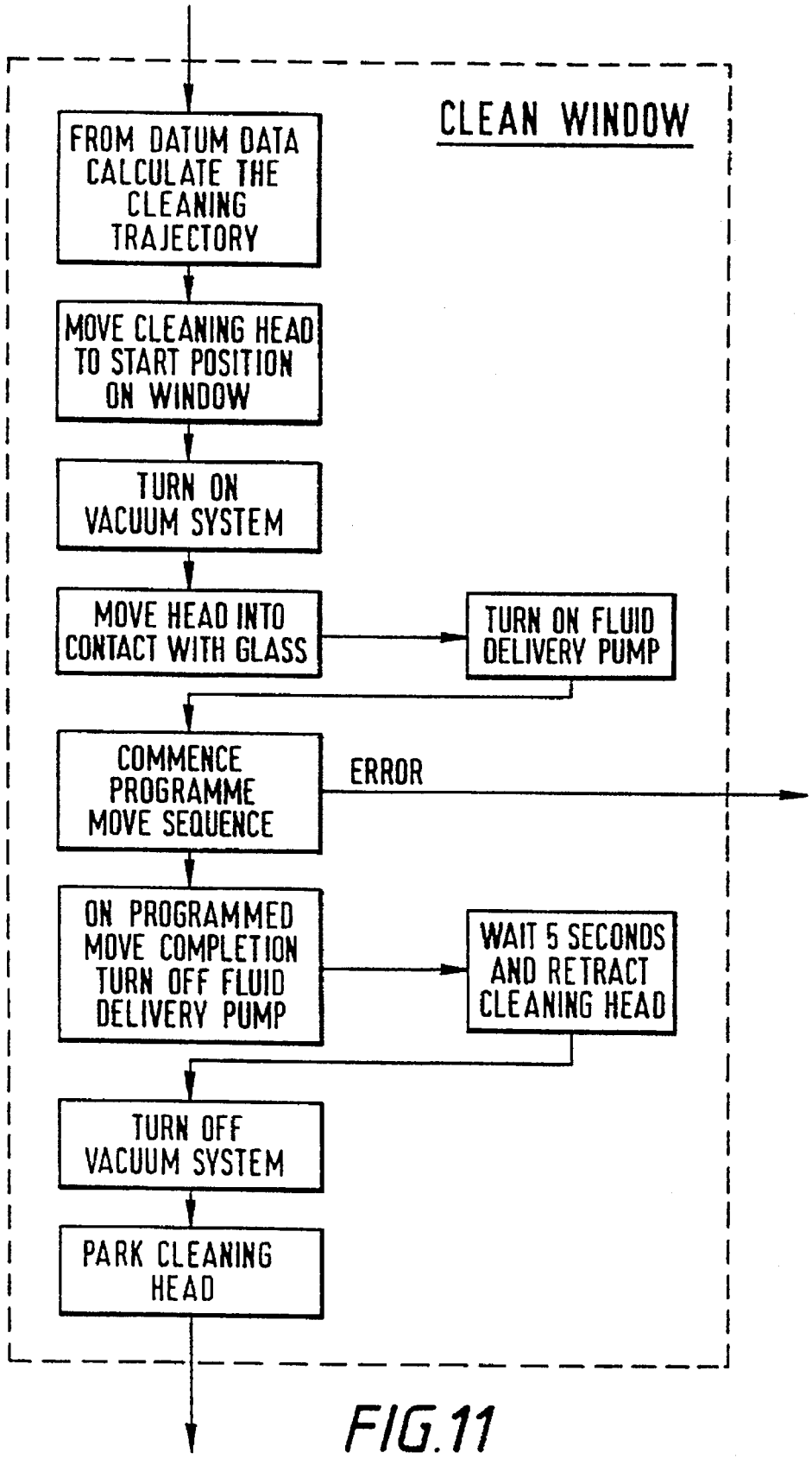

FIGS. 9 to 11 are flow charts illustrating the software strucutre for the robotic control.

Figure 1:
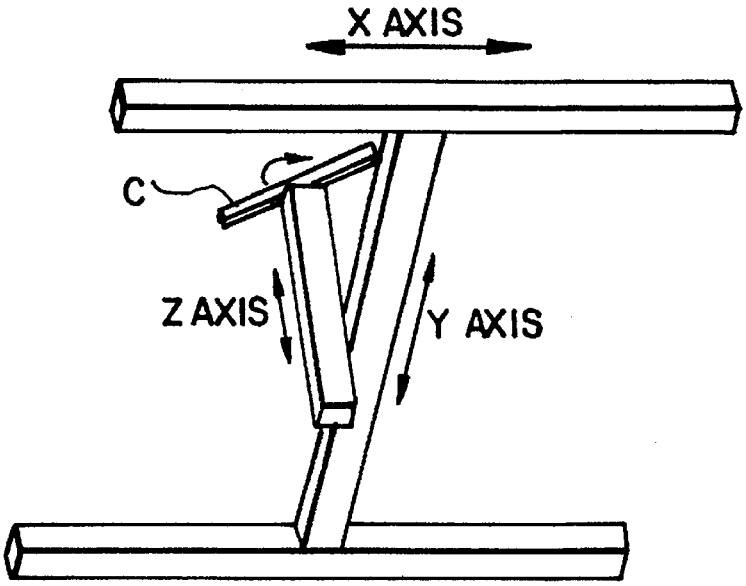
FIG. 1 is a schematic view of a control robot with a rotatably mounted cleaning head.

Referring initially to FIG. 1 of the drawings a cleaning device is diagrammatically illustrated and comprises an frame support with a vertical leg along the Y axis and upper and lower horizontal cross-members along the X axis. A support for the cleaning blade extends forwardly along the Z axis. Robotically controlled drive means allow the device to be moved along all three axes whilst an elongate cleaning head C is rotatable about the Z axis.

The cleaning head C has two modes of operation; a datum mode, and a cleaning mode. A cleaning head adapted to operate in these modes will be described hereinafter with reference to FIGS. 4 to 7, but initially these modes will be referred to functionally with reference to FIGS. 2A and 2B to explain how, in accordance with the invention, cleaning of a window is carried out.

Figure 2A:
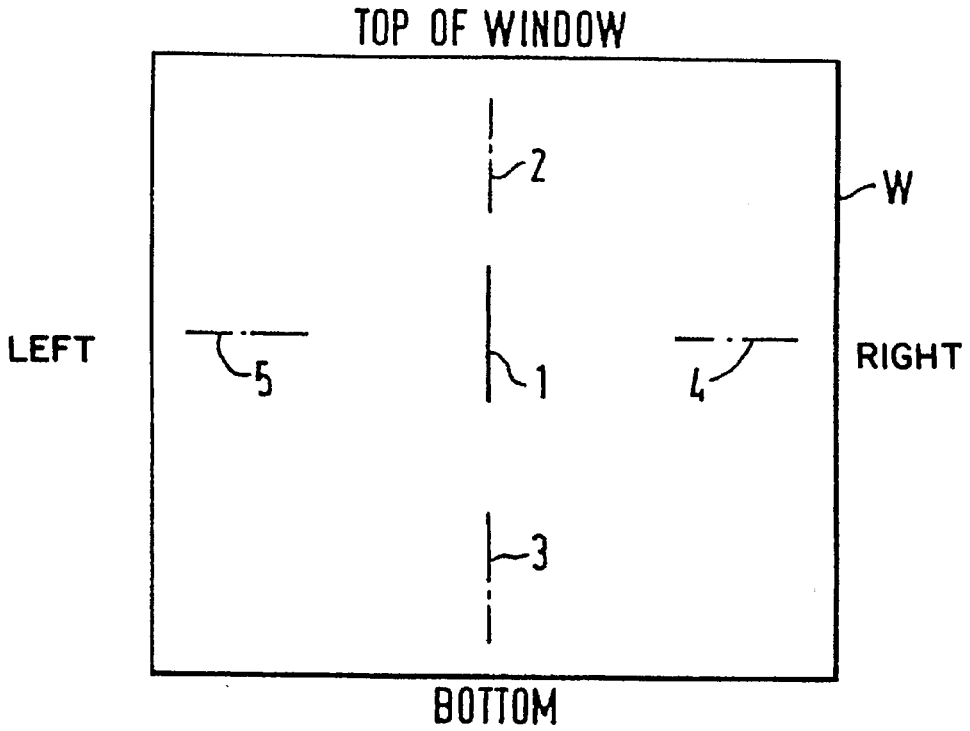
FIGS. 2A and 2B illustrate respectively datum and positioning and cleaning paths according to one operating plan.
Figure 2B:
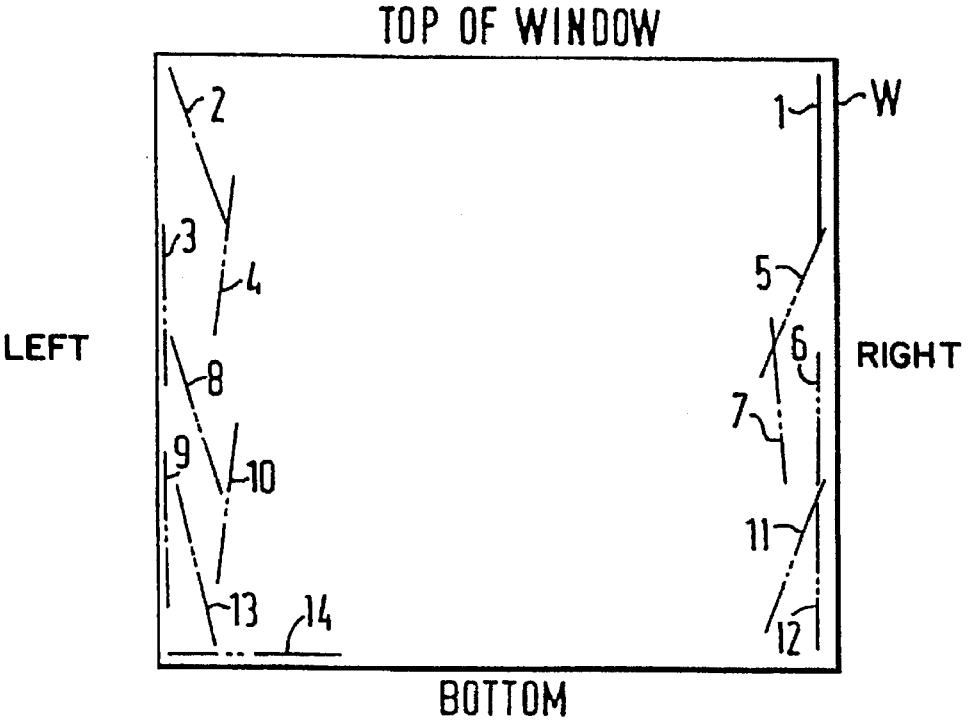

Referring to FIG. 2A the head in the datum mode and upright finds and contacts the window W at 1. It then moves up to 2 to find the top margin of the window, down to 3 to find the bottom margin, to 4 to find the right margin, and then to 5 to find the left margin. Electrical signals arising from these contacts 1 to 5 allow the dimensions of a rectangular window to be established and these are fed into a micro-computer which works out the cleaning path of FIG. 2B. An increased force is applied to the head which is then in the cleaning mode and the head performs the cleaning pattern illustrated by numbers 1 through 14 sequentially.

This pattern simulates that which a skilled window cleaner would perform manually with his squeegee starting (1) at the top right and finishing with the head horizontally disposed (14) at the bottom left. With this pattern one side only of the wiping part of the head contacts cleaning liquid thereby moving a body of liquid across the window for ultimate disposal.

Naturally the paths described and illustrated could be achieved by a revolute robot with a universally mounted head, i.e. a robot having full freedom of movement of the blade. However, the Cartesian robot capable of moving about the three axes with rotation only about the Z axis is simple and robust and is presently preferred for the present invention.

Figure 3:
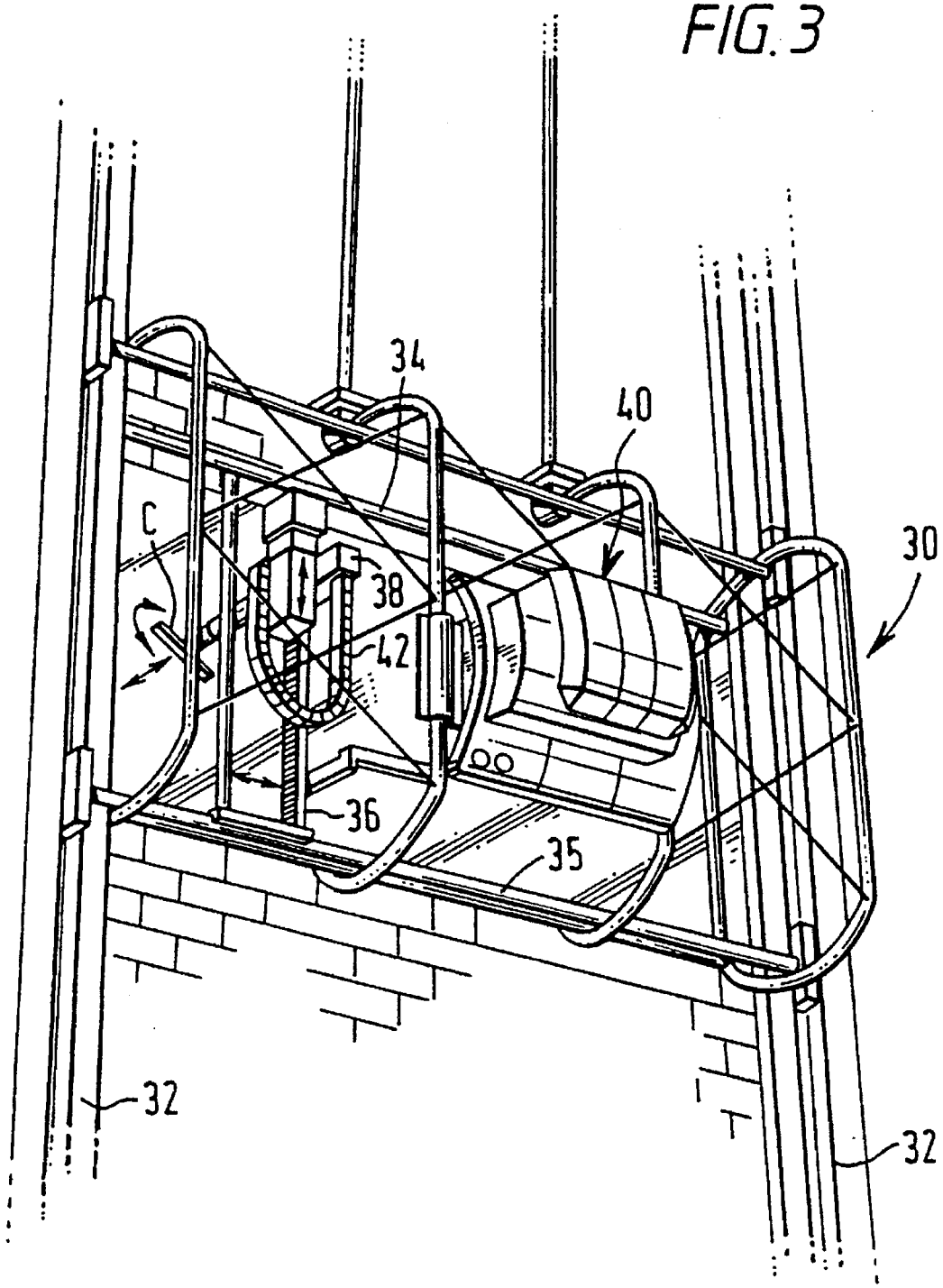

FIG. 3 shows a cleaning device mounted on a frame 30 on the exterior of a building, the windows of which are to be cleaned. The frame structure 30 can be moved vertically up and down the outside of the building between guides 32. At the upper end of its travel the frame structure can be moved laterally (by means not shown) so that it can be located between a different pair of guides to enable a different part of the building to be cleaned.

The frame structure includes upper and lower spaced parallel beams. A generally vertical beam 36 extends between the upper and lower beams 34, 35. Motors which operate through a rack and pinion arrangement can be energised to move the beam 36 along the length of the upper and lower beams 34, 35. This provides the movement along the X axis referred to above.

An arm 38 is carried by the vertical beam 36 and a further motor operating through a rack and pinion arrangement can be energised to move the arm upwardly and downwardly along the vertical beam 36. This provides movement along the Y axis referred to above.

The arm 38 is also mounted on the vertical beam 36 such that a further motor operating again through a rack and pinion arrangement can be energised to move the arm in its axial direction to thereby provide movement the Z axis.

The arm 38 carries at one end the cleaning head C which is shown schematically in FIG. 1 and which will be described in more detail below. The head is so mounted on the arm 38 that it can be rotated about the axis of the arm by energisation of a further motor.

These movements are illustrated in FIG. 3A. Particularly, motor M1 drives a pinion 23 engaged with a rack 25 along beam 34 to displace beam 36 in the X direction. Motor M2 carried by arm 38 drives a pinion 27 in engagement with a rack 29 on beam 36 to displace arm 38 in the Y direction. Motor M3 carried by a support between motor M2 and arm 38 drives a pinion 31 engaging a rack for displacing the arm 38 in a Z direction. Motor M4 is carried by arm 38 and drives the wiper head for rotation about the Z axis.

The frame structure also carries a housing which is shown generally at 40. The housing 40 accommodates the robotic control circuitry which will be described in more detail below. The housing 40 also accommodates a container or containers for cleaning fluid which is supplied to the cleaning head C when the window cleaning operation is carried out. Suitable electrical cabling and fluid conduits 42 extend from the housing 40 to the motors and the cleaning head C. The cables inter alia can transmit control signals from the robotic control to the motors to effect energisation of the motors and hence the required movement of the cleaning head. The cables also carry signals from motor control circuits and the cleaning head to the robotic control.

The fluid conduits are used to deliver cleaning fluid to and from the cleaning head C.

An example of a suitable form of cleaning head will now be described with reference to FIGS. 4 to 7. Referring to these figures, the cleaning head C is generally elongate and carries a forwardly extending wiper blade 60 which projects from one side edge of the front face of the cleaning head C. On the opposite side edge of the front face the head carries a cleaning brush 62 which also extends along the opposite end portions of the head to terminate adjacent opposite ends of the wiper blade 60. The brush 62 can be formed from suitable material such as bristles.

The head is formed with a first passage 64 which is connected to a pipe 65 which in turn is coupled to the supply of cleaning fluid by the fluid conduits referred to above. The cleaning fluid can be any appropriate cleaning fluid. The passage 64 terminates in a narrow bore 66 which is disposed so that cleaning fluid exiting therefrom impregnates the bristles as illustrated in FIG. 6.

The head also has a further passage 70 which is coupled by a pipe 71 to a vacuum source. This is used to retrieve cleaning fluid from the front of the head and return it to the fluid supply. In this respect, it will be seen that when the cleaning head is pressed against the surface 74 of a window the blade 60, the brush 62, and the front surface of the head form with the window a chamber into which the fluid flows from the passage 66 and from which it can be retrieved by vacuum retrieval. The fluid path includes a filter (not shown) which is used to clean fluid returning from the cleaning head. It will be seen that as the head is moved relative to the glass surface fluid from the impregnated brush 62 cleans the glass and the blade 60 acts to wipe the surface of the glass thereby ensuring that excess fluid is not left on the surface but maintained within the chamber and returned to the fluid supply by the vacuum retrieval referred to above.

As can be seen in FIG. 5, the head includes a series of passages 70 which are connected to the vacuum source.

The mounting arrangement for the cleaning head which allows the datumming and cleaning mode will now be described with reference to FIG. 4.

As can be seen, the head C is mounted on a holder 80 which is in turn mounted for limited forward and rearward pivotal movement within a support 82. The holder 80 is pivotally mounted on a pin 84 and connected to the support through springs 85. A microswitch 88 is mounted on the support 82 so that its contact arm is close to the rear face of the holder 80. The arrangement is such that rearward movement of the holder 80 against the light bias of the springs 85 is sensed by the microswitch 88 which in turn transmits a signal to the robotic control circuitry. This occurs when the head C initially contacts its window. That is to say, the contact pressure of the head C allows the holder 80 to actuate the microswitch and hence the robotic control. The holder 80 is mounted on the support 82 so that it can also move longitudinally by a small distance relative to that support 82. Proximity sensors (not shown) sense such movement when the head C is used to locate the edge of a window, the holder moves by a small distance on encountering the edge and the proximity detector transmits a signal to the control circuitry. This in effect constitutes the datumming mode which takes effect when the head is used as a sensor to locate the extremities of a window which is to be cleaned.

The support also has three rearwardly extending rods 90, 91, 92 each of which is received pistonwise in a cylinder in a structure 94 which is mounted on the end of the arm 38. The outer rods 90, 92 act as guides and are received in bearings 95. The center rod 91 locates within a coil spring 98 which acts to urge the holder 80 forwardly towards a window. The coil spring 98 is substantially stiffer than the springs 85 used in the datumming mode. The robotic control, can thus operate to exert an increased force during cleaning through the spring connection to the robot head.

FIG. 8 is a block schematic diagram of the robotic control circuitry. It comprises a PMAC motion control card 100 which operates in conjunction with a 286 CPU 101. The CPU has associated ROM/RAM 102 which is provided on a memory card. The memory card is connected to an input/output card 104 which has connections to a communications unit 100 for the roof trolley of the apparatus and to sensors 108 which identify the limits of the motion of the frame structure carrying the robotic control. The PMAC motion control card 100 can receive inputs from the cleaning head C acting in its datumming mode and also from encoders 110 associated with the motors. These are feedback signals from the motors which inform the motion control card of the current position and state of the motors. The PMAC motion control card 100 has outputs to the pump and vacuum system 112 and also to amplifiers 114 which are used to drive the motors which control the robot. The CPU has a link with a block 118 which is intended to represent programming and maintenance interface. The PMAC 100 is a conventionally available controller card whose operation and structure will be known to those skilled in the art. All the circuitry is commercially available.

The software required by the system shown in FIG. 8 is considered to be within the competence of a man skilled in the art of robotics and will vary according to the specific movements required of the cleaning head C. FIGS. 9 to 11 give flow charts which illustrate the basic structure of the software which can be used by the robotic control circuits. FIG. 9 shows the general structure of the software whilst FIG. 10 is a flowchart showing in more detail that part of the software shown as the datum window 110 in FIG. 9. This represents the function of the software during the datumming operation referred to above. Similarly FIG. 11 represents in more detail the clean window block shown on FIG. 9. This represents the function of the software required for the cleaning window operation.

We claim:

1. Cleaning apparatus for cleaning windows comprising frame structure, an elongate wiper element having a length less than a side of a window and carried by said frame structure, means carried by said frame structure and operatively coupled to the wiper element for moving said element continuously along and in continuous contact with the entire surface of the window during cleaning and without displacement of said wiper element from the surface of the window, and automated control means coupled to said moving means for controlling the movement of said element across the surface of the window, said element including a wiper blade in continuous contact with the surface of the window during cleaning.

2. Cleaning apparatus according to claim 1, wherein said moving means includes elements enabling movement of the wiper along an X-axis, a Y-axis, and a Z-axis of a Cartesian coordinate system wherein said X-axis and Y-axis define a plane parallel to a plane containing the window.

3. Cleaning apparatus according to claim 2, wherein said moving means includes elements enablinq the wiper for rotation about said Z-axis.

4. Cleaning apparatus according to claim 1 wherein the automated control means is programmed to cause the wiper to move back and forth between opposite sides of the window and from a top of the window downwardly to a bottom of the window thereby to simulate the movements of a human arm and hand when cleaning windows manually.

5. Cleaning apparatus according to claim 1, wherein said control means includes means comprising the wiper element and a sensor carried thereby for sensing the dimensions of the window to be cleaned.

6. Cleaning apparatus according to claim 5, wherein said control means includes processing means for establishing a pattern of movement to be followed by the wiper element during cleaning.

7. Cleaning apparatus according to claim 5, wherein the wiper element includes a member mounted for limited longitudinal movement responsive to contact of said wiper element with a window margin to actuate said sensor.

8. Cleaning apparatus according to claim 7, wherein the wiper element includes a member mounted for limited movement normal to its length and responsive to contact of said wiper element with the window to actuate a sensor of said control means during cleaning.

9. Cleaning apparatus according to claim 8, wherein said control means includes means for operating the wiper element in two modes, a first datum mode during which window margins are sensed, and a second mode during which cleaning occurs.

10. Cleaning apparatus according to claim 1, wherein said wiper element comprises a body, and an elongate cleaning portion carried by said body, said cleaning portion having projecting parts which when pressed into contact with a window form with the window a chamber, said body being formed with passages through which cleaning fluid can be applied to said chamber to clean said window.

11. Cleaning apparatus according to claim 10, wherein said projecting parts are formed by an elongate cleaning brush and an elongate wiper blade.

12. Cleaning apparatus for cleaning windows, comprising an elongate wiper element including a wiper blade, means for flowing a cleaning fluid through said wiper element onto a surface of the window, and an automated control means operatively coupled to said wiper element to control movement of said wiper element across the surface of the window, said control means causing said wiper element to make a single continuous sweep across the entire surface of the window to apply the cleaning fluid thereto and remove the cleaning fluid therefrom by said blade during the single continuous sweep of the wiper element across the surface of the window.

13. Cleaning apparatus according to claim 12, wherein the wiper is carried by a frame structure, said frame structure enabling movement of the wiper element along an X-axis, a Y-axis, and a Z-axis of a Cartesian coordinate system wherein said X-axis and said Y-axis define a plane parallel to a plane containing the window.

14. Cleaning apparatus according to claim 13, wherein the wiper element is rotatable about said Z-axis.

15. Cleaning apparatus according to claim 12, wherein said control means senses by traverse of said wiper element along the window the dimensions of the window to be cleaned.

16. Cleaning apparatus according to claim 15, wherein said control means includes processing means for establishing a pattern of movement to be followed by the wiper element during cleaning.

17. Cleaning apparatus according to claim 15, wherein the wiper element includes a member mounted for limited longitudinal movement responsive to contact of said wiper element with a window margin to actuate said sensor.

18. Cleaning apparatus according to claim 17, wherein the wiper element includes a member mounted for limited movement normal to its length and responsive to contact of said wiper element with the window to actuate a sensor of said control means during cleaning.

19. Cleaning apparatus according to claim 18, wherein said control means includes means for operating the wiper element in two modes, a first datum mode during which window margins are sensed, and a second mode during which cleaning occurs.

20. Cleaning apparatus according to claim 12, wherein said wiper element includes a cleaning head comprising a body, and an elongate cleaning portion carried by said body, said cleaning portion having projecting parts including said blade which, when pressed into contact with the window, form a chamber, said body having passages through which cleaning fluid is supplied to said chamber to clean said window.

21. Cleaning apparatus according to claim 20, wherein said projecting parts include an elongate cleaning brush.

* * * * *